US005673915A

United States Patent [19]

Shalders

[11] Patent Number: 5,673,915

[45] Date of Patent: Oct. 7, 1997

[54] BOARD GAME OF PROPERTY MANAGEMENT

[76] Inventor: Sidney Shalders, 43 Lincoln Street, Stanmore 2048, Sydney NSW, Australia

[21] Appl. No.: 653,491

[22] Filed: May 24, 1996

[51] Int. Cl.[6] ..... A63F 3/00

[52] U.S. Cl. ..... 273/256

[58] Field of Search ..... 273/242, 243, 273/248, 249, 256, 278

[56] References Cited

U.S. PATENT DOCUMENTS

| | | | |
|---|---|---|---|
| 2,026,082 | 12/1935 | Darrow | 273/256 |
| 2,976,044 | 3/1961 | Corpening | 273/256 |
| 4,871,177 | 10/1989 | Mock | 273/256 |
| 4,927,156 | 5/1990 | Breslow et al. | 273/256 |
| 4,936,589 | 6/1990 | Sinclair | 273/256 X |
| 5,169,154 | 12/1992 | Borghi | 273/256 |
| 5,388,836 | 2/1995 | Foti | 273/256 |

*Primary Examiner*—William E. Stoll
*Attorney, Agent, or Firm*—Michael I. Kroll

[57] ABSTRACT

A board game (10), which comprises a game board (12) having a continuous path (14) around its perimeter divided into consecutive spaces. Most of the spaces (16) bear names of states, airports, telephone companies and interstate highways with amounts of money needed to purchase them. The first corner space (18) bears the word "GO" indicating a start position. The second corner space (20) bears the abbreviation "IRS". The third corner space (22) bears the word "JAIL", a symbol for jail and the amount of money needed to pay to get out of jail. A fourth corner space (24) bears the word "BANK". A plurality of playing pieces (26) are provided, one for each of the game players. The playing pieces (26) are of a size to fit within each of the spaces (16), (18), (20), (22) and (24) on the game board (12).

1 Claim, 15 Drawing Sheets

38

A major telephone company is building a massive manufacturing plant in one of your state(s), which will create at least 1,000 new jobs. The BANK gives you $100

BANK

38

A minor tremor has struck part of your state, the damage bill is counted, you owe the BANK $100

BANK

38

Crime in your state(s) is on the increase, you owe $100 to the BANK to step up police presence

BANK

A heat wave has struck much of your state(s) causing hundreds of casualties & water reservoir levels have dropped dangerously low, you have a plan to bring in more water from other state(s). You owe the BANK $100

BANK

38

38

Crime in your state(s) is on the increase, you owe the BANK $50 for each state owned to put more police on the beat

BANK

Prison population is at an all time high in your state(s), more state penitentiaries are needed to be built, you owe the BANK $200 for new jails.

BANK

38

38

Vandalism is on the rise in your state(s), repair costs are needed, you owe the BANK $100

BANK

One of your state(s) has become a major leading producer of wheat & has won a huge International order, the BANK gives you $100

BANK

38

Fig. 6A

A major earthquake measuring 5.8 on the Richter Scale has rocked one of your state(s) leaving behind casualties & widespread damage, you owe the BANK $100

BANK

38

One of your state(s) has become a major leading producer of beef cattle, the BANK gives you $100

BANK

38

38

Foreign investment in your state(s) has fallen affecting your budget, you owe the BANK $150

BANK

38

Exports of Coal & Iron ore shipments are up from one of your state(s), the BANK gives you $100

BANK

38

Street crime is at an all time high in your state, more police are needed. You owe the BANK $200 to employ more police officers

BANK

38

Vast pools of mineral resources have been found in your state, the BANK gives you $100

BANK

38

38

The cost of crime is at an all time low, your state(s) budget is in excess of $100.
The BANK gives you $50 for every state owned

BANK

38

Medical insurances are on the increase in your state(s), you owe the BANK $100

BANK

Fig. 6B

38

Patient waiting lists are on the rise & there's a general out cry for more public hospitals to be built in your state, you pass a bill which is made into law allowing for more hospitals to be built, you owe the BANK $150

BANK

38

Wild fires strike your state(s) damaging property, you owe the BANK $100

BANK

38

A second major power plant needs to be built in your state(s), you owe the BANK $100

BANK

Strong winds & Tornados have struck your state(s), the repair bill has been counted. You owe the BANK $100

BANK

38

38

Crude oil is found underground in your state(s), the BANK gives you $100

BANK

Job market vacancies in your state are at an all time high & unemployment is at a record low, the BANK gives you $100

BANK

38

Major resorts are built in your state(s) which increases the tourist trade, the BANK gives you $100 for each state owned

BANK

A major car maker has built it's manufacturing plant in one of your state(s) providing thousands of new jobs, the BANK gives you $100

BANK

38

38

Fig. 6C

38

Constant rains & floods ravage 30% of your state(s), a state of emergency is declared. You owe $100 to the BANK

BANK

38

A major manufacturer has expanded it's operations in your state(s), the BANK gives you $100

BANK

38

Land prices & properties soar in your state(s), the BANK gives you $100

BANK

Land prices drop in your state(s) & the property market is in a slump, you owe the BANK $100

BANK

38

38

A major airport in your state needs upgrading, the cost is $100, you owe the BANK $100

BANK

Motor vehicle sales are up & car sales are at a record high in your state(s), the BANK gives you $100

BANK

38

More Freeways need constructing in your state(s), you owe the BANK $100 for each state owned

BANK

A main Freeway in your state requires a major upgrade, you owe the BANK $100

BANK

38

38

Fig. 6D

36

The job market is currently in a slump & unemployment is high in your state(s), you owe the IRS $50 for each state owned

IRS

36

Retail sales fall in your state(s), you owe the IRS $100

IRS

36

A massive reservoir dam has been built in one of your state(s), you owe the IRS $100

IRS

Foreign imports into your state(s) are up & exports are down, you owe the IRS $100

IRS

36

36

The Educational budget has been increased in your state(s), you owe the IRS $150

IRS

Consumer speeding in your state(s) has fallen, you owe the IRS $100

IRS

36

A new job creation bill has been passed in your state(s) & made into law, you owe the IRS $100

IRS

36

A foreign company has won a take over bid for a major company in your state, you owe the IRS $100

IRS

36

Fig. 7A

36

Tourism in your state(s) has fallen & affected your states' small business industry, you owe the IRS $100

IRS

36

36

Taxes are on the increase in your state(s), you owe the IRS $100

IRS

36

Taxes are on the increase in your state(s), you owe the IRS $200

IRS

36

You owe the IRS $100 in back taxes.

IRS

36

You owe the IRS $100 in back taxes

IRS

36

You owe the IRS $200 in back taxes

IRS

36

Exports from your state(s) are down, you owe the IRS $100

IRS

36

The cost of farm produce is on the increase in your state(s), you owe the IRS $100

IRS

36

Fig. 7B

36

Consumer retail sales are on the increase in your state(s), the IRS gives you $100

IRS

36

A comprehensive Health Care reform bill has been passed in your state(s) & made into law, you owe the IRS $100

IRS

36

Health Care costs rise in your state(s), you owe the IRS $50 for each state owned

IRS

A new Welfare reform bill has been passed in your state(s) & made into law which will improve support & new job creation schemes, you owe the IRS $50 for each state owned

IRS

36

36

More Hospitals need to be built in your state(s) but funds are urgently needed, you owe the IRS $100

IRS

A new study has shown a steady stream of the population from your state(s) are moving away to other states because of rising costs, you owe the IRS $100

IRS

36

36

A large company in your state(s) has won a major international order to supply medical equipment, you owe the IRS $100

IRS

A major bank in your state has made a bad investment, you bail out the bank. You owe the IRS $150

IRS

36

Fig. 7C

36

Supply of farm produce is low because of lack of rain this season, the IRS is owed $100

IRS

36

The price of gasoline is on the rise in your state(s), you owe the IRS $50

IRS

36

A major manufacturer has laid off 2,000 employees leaving behind mass unemployment in your state, you owe the IRS $100

IRS

Electricity charges are on the rise in your state(s), you owe the IRS $100

IRS

36

36

The Social Security budget in your state(s) needs to be increased, you owe the IRS $100

IRS

Sewage treatment in your state(s) needs upgrading, you owe both the IRS & the BANK $100 each

IRS

36

36

A new crime bill has been passed, an increase in your state's budget needs adjusting, you owe the IRS $100

IRS

A leading international telephone company has invested heavily in your state(s) telecommunications network, the IRS gives you $100

IRS

36

Fig. 7D

| Game Pieces | Red pieces | White pieces | Blue pieces | Grey pieces |
|---|---|---|---|---|
| 42 Single City | 24 Single Cities | 24 Single Cities | 24 Single Cities | 24 Single Cities |
| 44 Second City | 24 Second Cities | 24 Second Cities | 24 Second Cities | 24 Second Cities |
| 40 House | 36 Owned states | 36 Owned states | 36 Owned states | 36 Owned states |
| | 84 pieces | 84 pieces | 84 pieces | 84 pieces |

The colored Game Pieces represent each opponents owned property[1] on the board game. Opponents can only use one color throughout each game.

[1]States with single or second cities are represented by their own Game Pieces

The House Game Piece represents an owned state with no city or cities

Owned Airports, Telephone Companies & Interstates are represented by the House Game Piece

Fig. 8

BOARD GAME OF PROPERTY MANAGEMENT

BACKGROUND OF THE INVENTION

1. Field of the Invention

The instant invention relates generally to board games and more specifically it relates to a Let's Buy USA game.

2. Description of the Prior Art

Numerous board games have been provided in prior art that are adapted to entertain the players by challenging them, so that they utilize their skill and acumen in playing the games, while at the same time, an element of chance adds a bit of adventure and luck to the games. While these units may be suitable for the particular purpose to which they address, they would not be as suitable for the purposes of the present invention as heretofore described.

SUMMARY OF THE INVENTION

A primary object of the present invention is to provide a Let's Buy USA game that will overcome the shortcomings of the prior art devices.

Another object is to provide a Let's Buy USA game in which the players utilize financial situations in purchasing states, airports, telephone companies or interstate highways, when playing the game.

An additional object is to provide a Let's Buy USA game in which there is a balance between skill and chance when playing the game, so as to entertain all of the players.

A further object is to provide a Let's Buy USA game that is simple and easy to use.

A still further object is to provide a Let's Buy USA game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIGS. 6A to 6E are plan views of the various bank cards.

FIGS. 7A to 7E are plan views of the various IRS cards.

FIG. 8 is a chart showing the various game pieces needed for playing the game.

Similar reference characters denote corresponding features consistently throughout the attached drawings.

DETAILED DESCRIPTION OF TEE PREFERRED EMBODIMENTS

Figure 1:
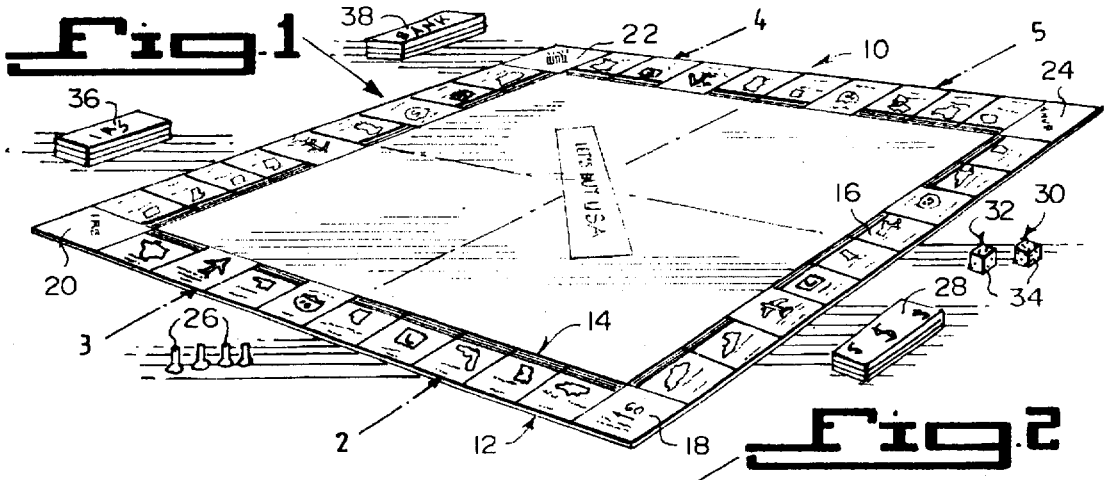
FIG. 1 is a perspective view showing the various components of the instant invention.
Figure 2:
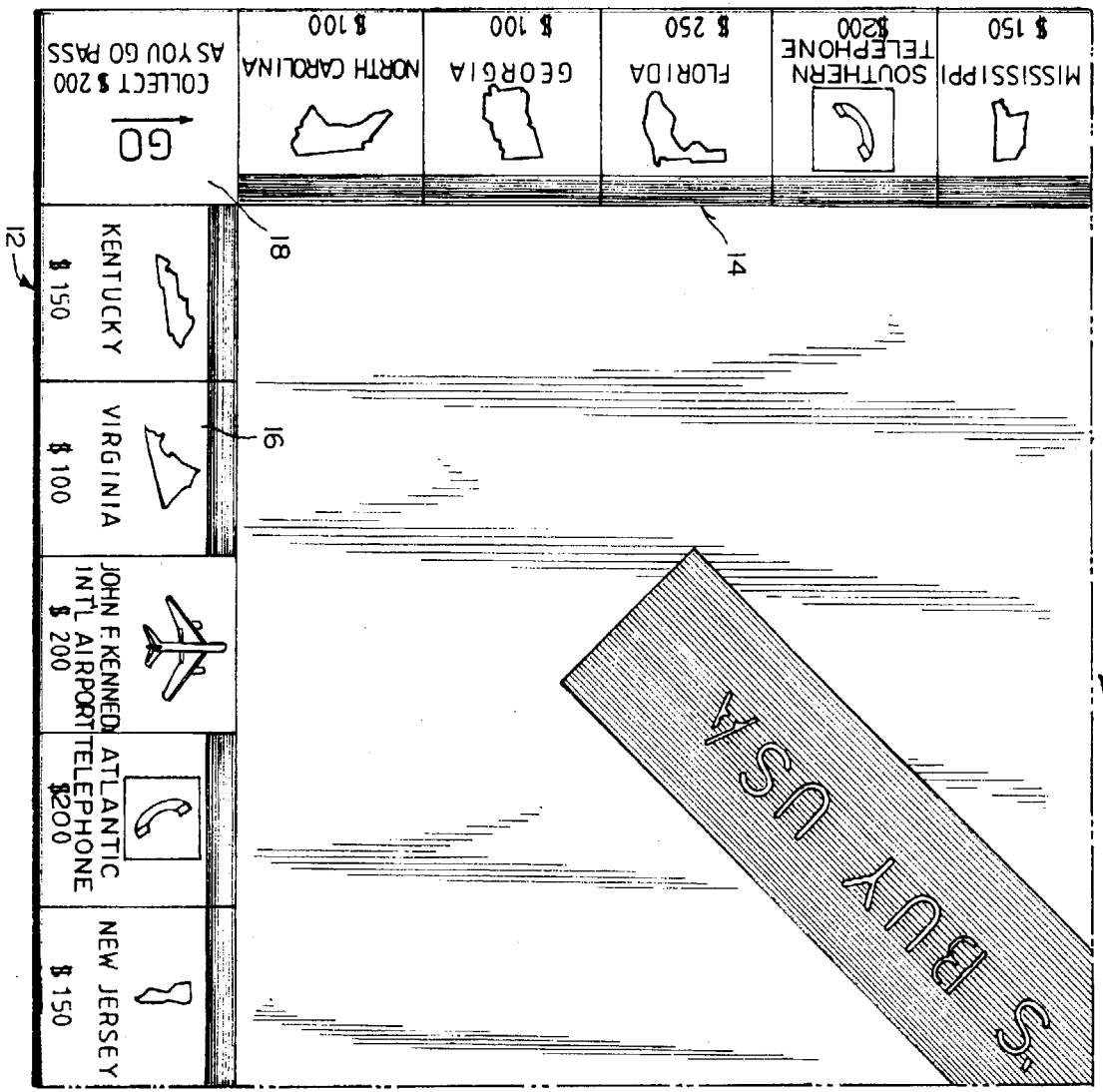
FIG. 2 is an enlarged top view of a first portion of the game board as indicated by arrow 2 in FIG. 1.
Figure 3:
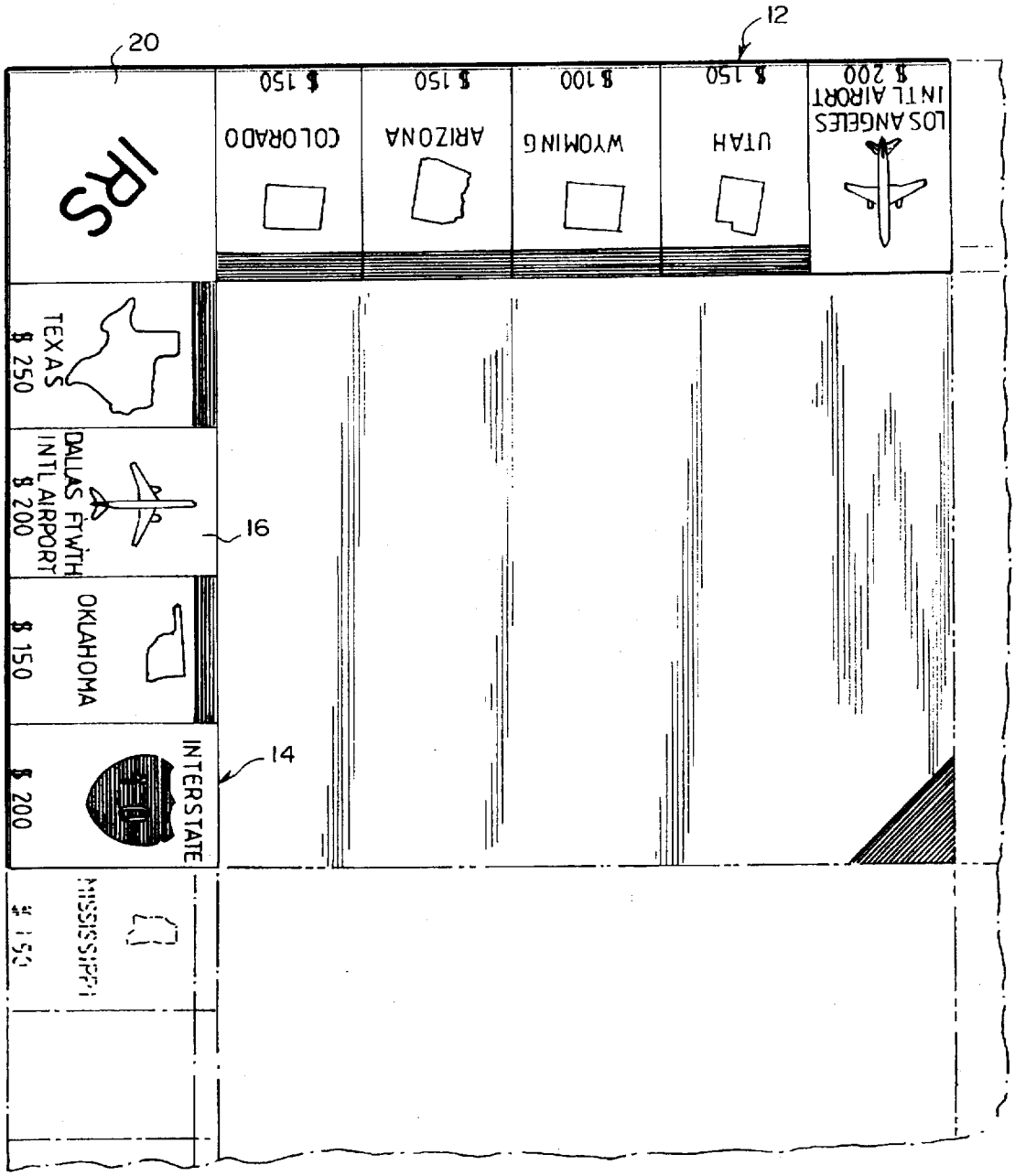
FIG. 3 is an enlarged top view of a second portion of the game board as indicated by arrow 3 in FIG. 1.
Figure 4:
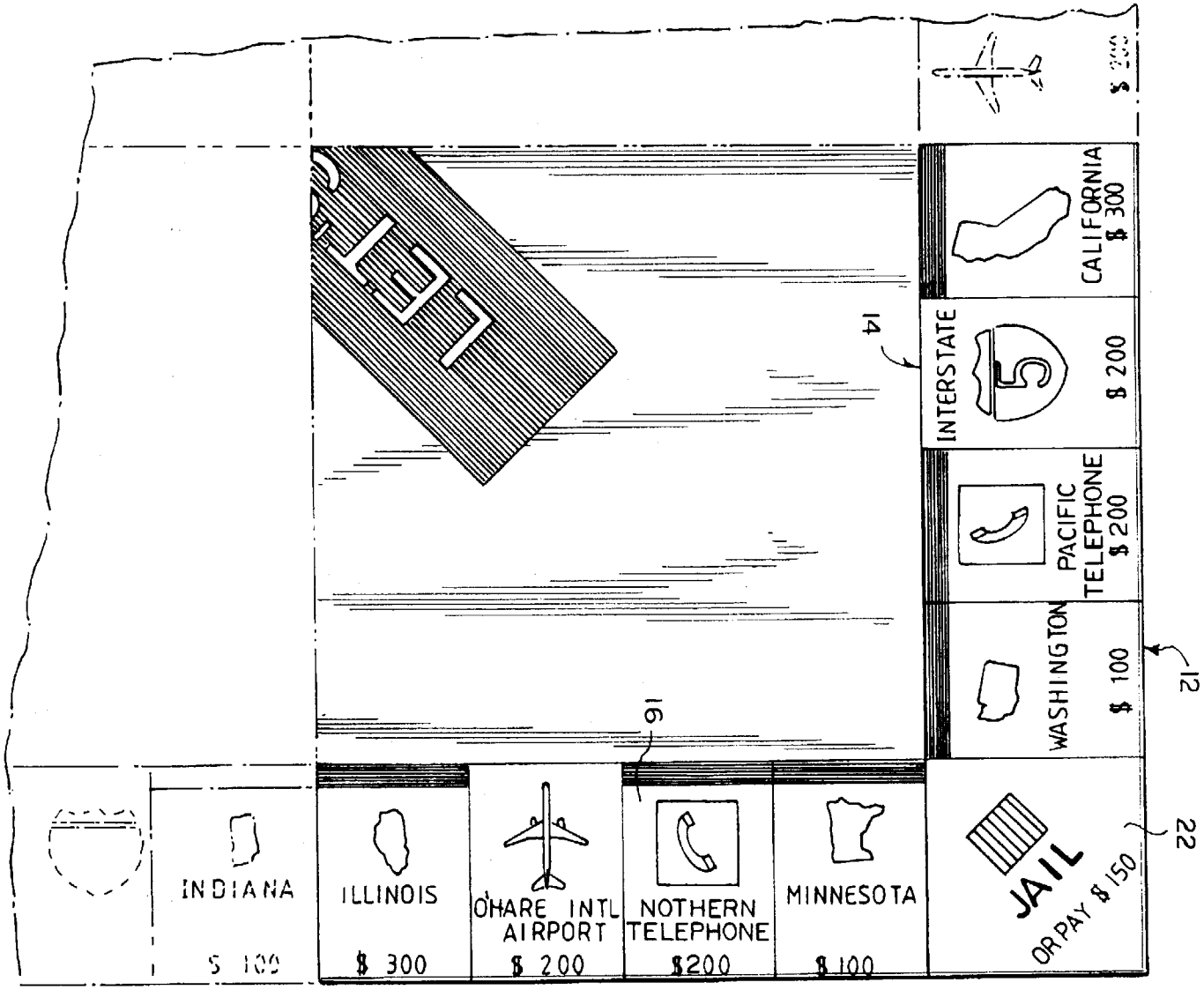
FIG. 4 is an enlarged top view of a third portion of the game board as indicated by arrow 4 in FIG. 1.
Figure 5:
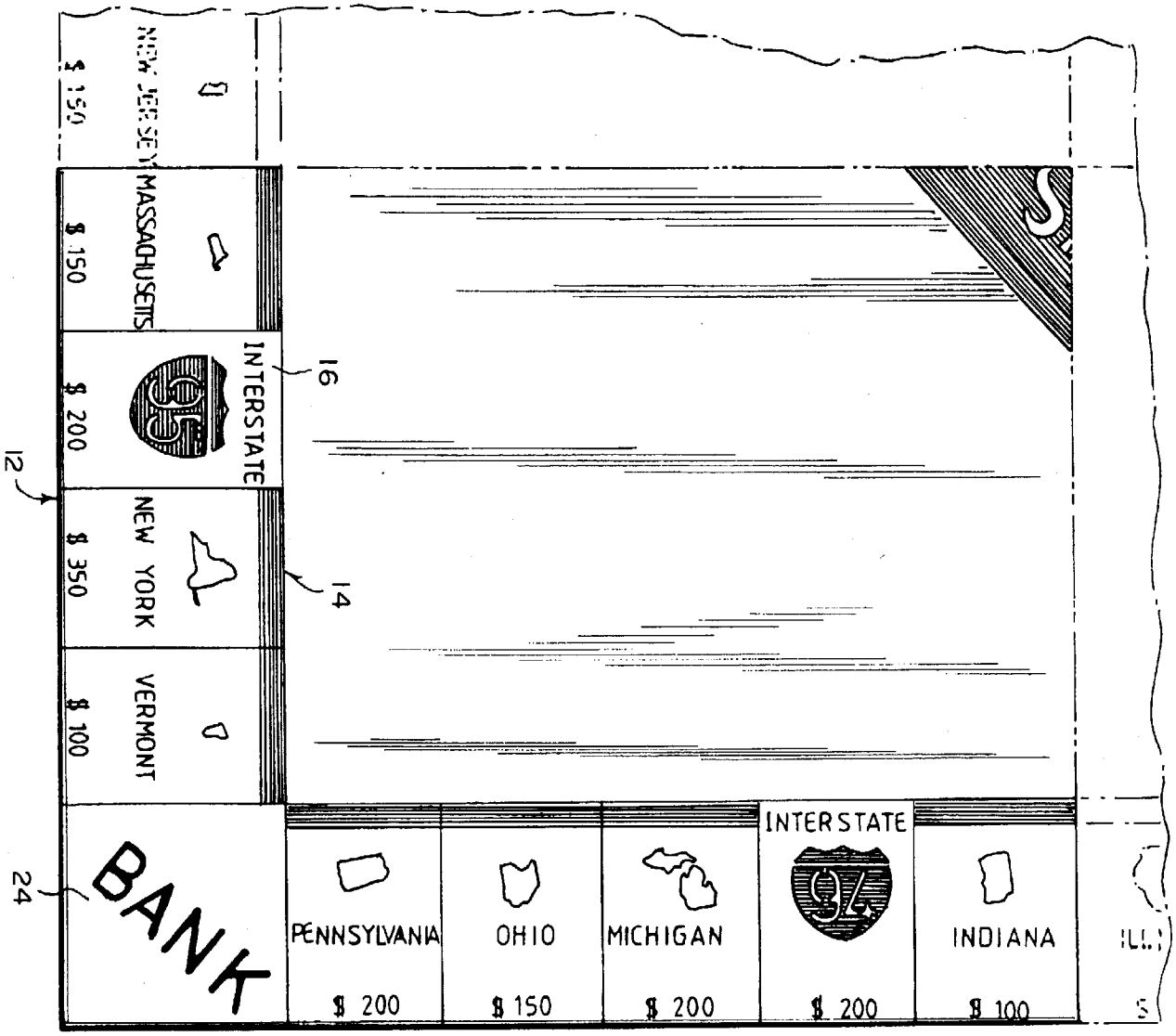
FIG. 5 is an enlarged top view of a fourth portion of the game board as indicated by arrow 5 in FIG. 1.
Figure 6E:
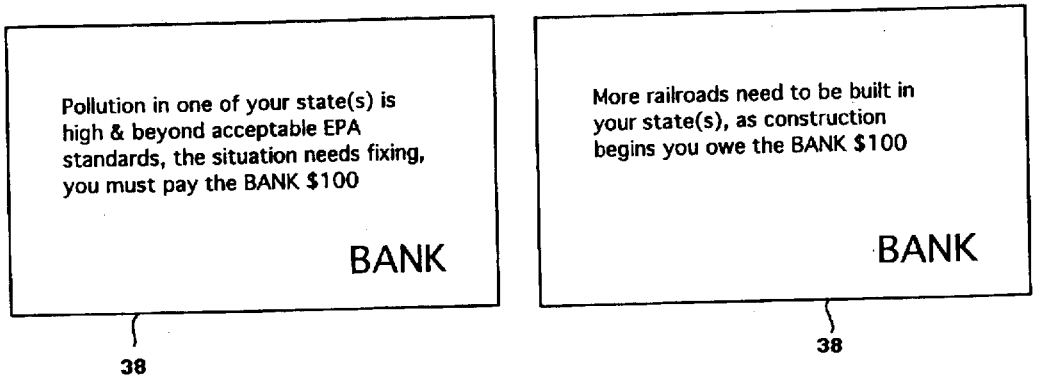
Figure 7E:
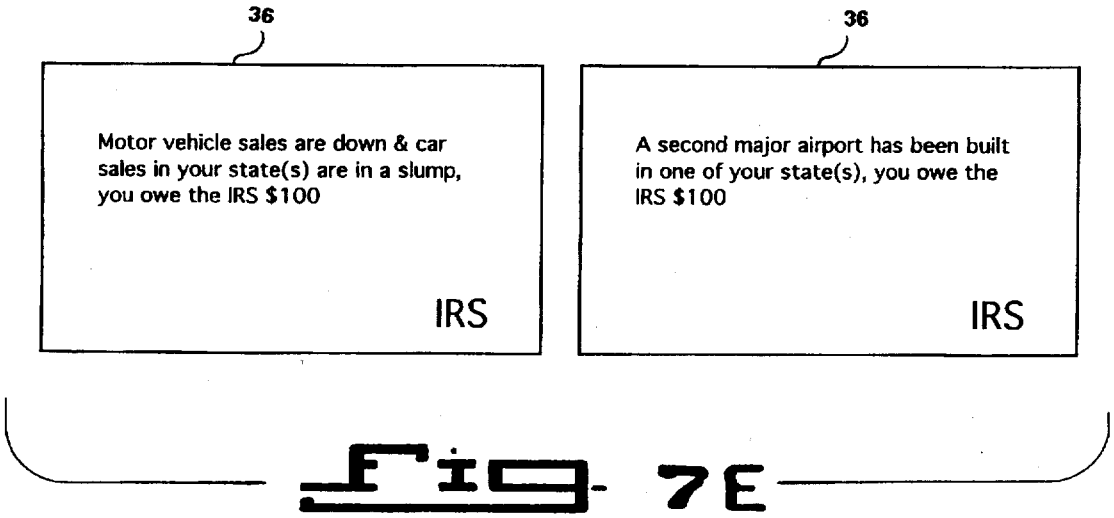

Turning now descriptively to the drawings, in which similar reference characters denote similar elements throughout the several views, FIGS. 1 through 8 illustrate a Let's Buy USA game 10, which comprises a game board 12 having a continuous path 14 around its perimeter divided into consecutive spaces. Most of the spaces 16 bear names of states, airports, telephone companies and interstate highways, with amounts of money needed to purchase them. The first corner space 18 bears the word "GO" indicating a start position. The second corner space 20 bears the abbreviation "IRS". The third corner space 22 bears the word "JAIL", a symbol for jail and the amount of money needed to pay to get out of jail. A fourth corner space 24 bears the word "BANK". A plurality of playing pieces 26 are provided, one for each of the game players. The playing pieces 26 are of a size to fit within each of the spaces 16, 18, 20, 22 and 24 on the game board 12.

Play money 28 of different denominations, is for distribution of part thereof to each player. A chance determining facility 30 indicates the movement of each playing piece 26, to a particular space 16, 18, 20, and 24 in the path 14 on the game board 12. The chance determining facility 30 includes two cubed gaming pieces 32. Each cubed gaming piece 32 will produce a random output count in positive integers, with each integer being a number in a base seven system. The cubed gaming pieces 32 are a standard pair of dice 34.

A plurality of IRS cards 36 are placed in a deck. When one playing piece 26 lands on the second corner space 20, that player will pick the top IRS card 36 from the deck and follow instructions thereon (see FIGS. 7A to 7E). A plurality of BANK cards 38 are placed in a deck. When one playing piece 26 lands on the fourth corner space 24, that player will pick the top BANK card 38 from the deck and follow instructions thereon (see FIGS. 6A to 6E).

As shown in the chart in FIG. 8, a plurality of miniature house game pieces 40 are distinctively identified to form a set for each player. The house game pieces 40 can be purchased and used by the players on the spaces 16 for states, airports, telephone companies and interstate highways owned on the game board 12. A plurality of miniature single city game pieces 42 are distinctively identified to form a set for each player. The single city game pieces 42 can be purchased and used by the players on the spaces 16, for states owned on the game board 12.

A plurality of miniature second city game pieces 44 are distinctively identified to form a set for each player. The second city game pieces 44 can be purchased and used by the players on the spaces 16, for states owned on the game board 12.

RULES OF THE GAME

1. Each player starts off with $700 dollars at the beginning of each game.
2. When landing on an IRS or BANK space with no cash in reserve and instructed to pay money, a player has to forfeit one of the states to the Federal Reserve. That can be any of players choosing regardless of a city or more. The player is allowed only the original cash price for the state with cities omitted, airports, telephone companies or interstate highways the player owns to sell to the Federal Reserve to pay the IRS or BANK.

3. Once a state, airport, telephone company or interstate highway has been forfeited, it becomes free land until a player lands on it and purchases it.
4. The Federal Reserve is the central government authority which sells unowned land and purchases back properties from players, as well as giving each the 200 dollars when passing the GO space in the game board.
5. To build a single city on a players state the player must pay the Federal Reserve 600 dollars when it is the players turn. Each player is allowed to have a maximum of two cities per state. The price of a second city in each state will cost another 600 dollars, making the total price of two cities in a state 1,200 dollars.
6. Landing on a state without a city, but belonging to another player will cost the player 50 dollars.
7. Landing on another player's state with a single city will cost the player 200 dollars. Landing on another player's state with two cities will cost the player 400 dollars.
8. Landing on another player's airport, telephone company or interstate highway will cost the player 200 dollars.
9. If a player owns all the airports, another player must pay that owner the total cost of all the airports together, if that player lands on any airport. Similarly, if a player owns all the telephone companies or interstate highways, another player must pay that owner the total cost of all the telephone companies or interstate highways together, if the player land on any one of them.
10. If a player lands on any property, such as a state (whether it has a single city or more), airport, telephone company or interstate highway owned by another player and that player has no money, the player can sell his own property back to the Federal Reserve for the original cash price to pay the owner. This can be any property or properties belonging to the player. Once a state, airport, telephone company or interstate highway has been forfeited, it becomes free land until a player lands on it and purchases it.
11. If the player cannot afford to pay the owner the price, then that player has to forfeit the game. The property or properties owned by that player then becomes free land. This does not include property already free to be purchased by any player landing on it.
12. When landing on the IRS space, a player must pick up a single IRS card from the top of the deck. Similarly, when landing on the BANK space, a player must pick up a single BANK card from the top of the deck.
13. If a player lands on the JAIL space, that player must pay 150 dollars to the Federal Reserve, to get out of JAIL the next time it is that players turn. If the player does not want to pay the 150 dollars required to get out of JAIL, then that player can roll the pair of dice when it is that players turn. If double numbers appear on the pair of dice that player can get out of JAIL without paying the required amount.
14. The last player remaining in the game wins.

LIST OF REFERENCE NUMBERS

10 Let's Buy USA game
12 game board of 10
14 continuous path on 12
16 space in 14
18 first corner space "GO" in 14
20 second corner space "IRS" in 14
22 third corner space "JAIL" in 14
24 fourth corner space "BANK" in 14
26 playing piece of 10
28 play money of 10
30 change determining facility of 10
32 cubed gaming piece of 30
34 standard pair of dice for 32
36 IRS card of 10
38 BANK card of 10
40 miniature house game piece of 10
42 miniature single city game piece of 10
44 miniature second city game piece of 10

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A board game, which comprises:

a) a game board having a continuous path around its perimeter divided into consecutive spaces, most of the spaces bearing names of states, airports, telephone companies and interstate highways with amounts of money needed to purchase them, the first corner space bearing the word "GO" indicating a start position, the second corner space bearing the abbreviation "IRS", the third corner space bearing the word "JAIL", a symbol for jail and the amount of money needed to pay to get out of jail and a fourth corner space bearing the word bank;

b) a plurality of playing pieces, color coded one for each of the game players, said playing pieces being of a size to fit within each of the spaces on said game board;

c) play money of different denominations for distribution of part thereof to each player;

d) a chance determining means comprising dice to indicate the movement of each said playing piece to a particular space in the path on said game board;

e) a plurality of IRS cards placed in a deck, whereby when one said playing piece lands on the second corner space, that player will pick the top IRS card from the deck and follow instruction thereon and become familiar with actions taken by the IRS, usually resulting in the necessity to pay additional taxes;

f) a plurality of BANK cards placed in a deck, whereby when one said playing piece lands on the fourth corner space, that player will pick the top BANK card from the deck and follow instruction thereon and become acquainted with a variety of different banking functions;

g) a plurality of miniature house game pieces, distinctively. Identified to form a set for each player coded by color to match the color of the player's playing piece, so that said house game pieces can be purchased and used by the players on said spaces for states, airports, telephone companies and interstate highways owned on said game board;

h) a plurality of miniature single city game pieces each in the form of a skyscraper distinctively identified to form a set for each player coded by color to match the color of the player's playing piece, so that said single city game pieces can be purchased and used by the players on said spaces for states owned on said game board; and i) a plurality of miniature second city game pieces each in the form of a pair of adjoining skyscrapers distinctively identified to form a set for each player coded by color to match the color of the player's playing piece, so that said second city game pieces can be purchased and used by the players on said spaces for states owned on said game board for identifying a second city in a state where there is already one city established.

* * * * *